US006277221B1

(12) United States Patent
Lundstrom

(10) Patent No.: US 6,277,221 B1
(45) Date of Patent: Aug. 21, 2001

(54) PROPELLANT COMPOSITIONS WITH SALTS AND COMPLEXES OF LANTHANIDE AND RARE EARTH ELEMENTS

(75) Inventor: Norman H. Lundstrom, Manassas, VA (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/289,959

(22) Filed: Apr. 13, 1999

(51) Int. Cl.[7] ..... C06B 31/00; C06B 47/08

(52) U.S. Cl. ..... 149/45; 149/36; 149/92; 423/263

(58) Field of Search ..... 149/45, 36, 92

(56) References Cited

U.S. PATENT DOCUMENTS 3,819,380 * 6/1974 Baldasarri et al. ..... 96/76 R
5,035,757 * 7/1991 Poole ..... 149/46
5,139,588 * 8/1992 Poole ..... 149/61
5,725,699 * 3/1998 Hinshaw et al. ..... 149/45
5,735,118 * 4/1998 Hinshaw et al. ..... 149/45
5,780,768 * 7/1998 Knowlton et al. ..... 149/36
5,872,329 * 2/1999 Burns et al. ..... 149/36
5,959,242 * 9/1999 Kowlton et al. ..... 149/45
5,970,703 * 10/1999 Hinshaw et al. ..... 149/45
6,017,404 * 1/2000 Lundstrom et al. ..... 149/36
6,039,820 * 3/2000 Hinshaw et al. ..... 149/45
6,074,502 * 6/2000 Burns et al. ..... 149/36
6,077,371 * 6/2000 Lundstrom et al. ..... 149/37

* cited by examiner

*Primary Examiner*—Peter M. Poon
*Assistant Examiner*—Glenda L. Sánchez
(74) *Attorney, Agent, or Firm*—Nixon & Vanderhye P.C.

(57) ABSTRACT

Solid pyrotechnic gas generant compositions and monopropellants are provided for use in inflators of automotive air bag restraint systems which, when combusted, produce acceptable burning rates, generate a high concentration of substantially innocuous gases, and a low concentration of substantially water insoluble non-toxic solid combustion products which limits the potential for asthmatic and pulmonary conditions. The propellant compositions provided are based on metal salts of lanthanide and rare earth elements, particularly lanthanide or rare earth nitrate salts and lanthanide or rare earth complexes with nitrogen-containing cations and nitrate anions. Scandium and cerium are preferred lanthanide and rare earth elements for these compositions.

16 Claims, No Drawings

PROPELLANT COMPOSITIONS WITH SALTS AND COMPLEXES OF LANTHANIDE AND RARE EARTH ELEMENTS

TECHNICAL FIELD

The present invention relates generally to gas generating propellant compositions and specifically to gas generating propellant compositions with complexes of lanthanide and rare earth elements that can function as single component monopropellants or as constituents of a multiconstituent propellant composition useful in automotive air bags and the like.

BACKGROUND ART

Gas generating composition useful for such applications as inflating automotive air bags must meet specific design criteria established by industry standards. For example, gas must be produced at a required rate. The gas that is generated must be innocuous and may contain, if any, only strictly limited amounts of toxic or harmful gases. Moreover, the gas generated must maintain an acceptable burn rate, but the gas generated must not reach a temperature that will injure a vehicle occupant when an air bag inflates or damage the air bag. A gas generating composition useful for this purpose should produce only a limited quantity of particulate materials, and any solids produced must not be harmful or toxic. If solids are produced by the gas generating composition, they should optimally be in the form of a filterable, solid slag. Such solids can be filtered to prevent their interference with gas generating apparatus and their escape into the surrounding environment. Smoke and water soluble particulates from combusted air bag propellants may produce and aggravate pulmonary conditions, especially pre-asthmatic and asthmatic conditions.

The requirements for a gas generator suitable for use in vehicle air bags are clearly very demanding. The generator must burn very fast, on the order of about 30 milliseconds or less, to inflate the air bag. The burn rate must be stable, controllable and reproducible to ensure rapid deployment and inflation of the air bag so that the occupants of the vehicle are not injured and the air bag is not damaged. Ignition of the gas generator must be certain, and the propellant burn rate and inflation time must remain within a required envelope despite extensive exposure of the generator composition to vibration and a wide range of temperatures. The gas generator composition must reliably generate an optimum quantity of innocuous gas during the life of the vehicle, which could be ten years or more. The gas generator composition, moreover, should be insensitive to moisture and must efficiently produce cool, nontoxic, noncorrosive gas at an acceptable temperature that is easily filtered to remove any solid or liquid particles. Combustion of the gas generator composition should ideally produce only water insoluble solid decomposition products that are not respiratory system irritants.

The prior art has proposed a large number of different types of gas generating propellant compositions for use in vehicle air bags and similar safety systems. The majority of the available propellant compositions, while effective gas generators, suffer from various drawbacks. Sodium azide-based gas generating compositions have been those most commonly used in automobile passive restraint systems. Although sodium azide compositions meet most specifications and guidelines for air bag gas generators, they have presented toxicity problems, both alone and with commonly used oxidizers. The solid particulates produced by the combustion of sodium azide-based compositions and non-azide based compositions are water soluble, and may be easily inhaled by vehicle occupants when an air bag deploys and produces smoke. Moreover, the disposal of both deployed and unused air bag inflators with either sodium azide or non-azide gas generants containing poisonous ingredients or water soluble combustion products can present a potential for environmental toxicity.

U.S. Pat. Nos. 5,429,691, 5,592,812 and 5,735,118 to Hinshaw et al. disclose gas generating compositions intended as replacements for sodium azide in vehicle air bags. U.S. Pat. No. 5,429,691 discloses a gas generating composition that includes an oxidizable inorganic fuel, preferably of a transition metal, silicon, boron, aluminum, magnesium, an intermetallic compound, hydrides of metals and mixtures, and an oxidizing agent containing oxygen and a metal. Basic metal carbonates and nitrates are stated to be acceptable oxidizing agents. The reaction for this system does not begin below about 225° F., and theoretical gas yields are disclosed to be comparable to sodium azide systems. The uses of cerium or scandium nitrate or cerium or scandium complex nitrates are not discussed as oxidizing agents or monopropellants. Also, compositions containing azodicarbon-amidine dinitrate and/or diammonium 5,5'bitetrazole organic fuels are not disclosed U.S. Pat. No. 5,592,812 discloses gas generating compositions formed from complexes of transition metals or alkaline earth metals. The complex includes a cationic metal template, sufficient oxidizing anion to balance the charge of the complex and a neutral ligand with hydrogen and nitrogen. Cobalt is the preferred metal. The disclosed complexes rapidly combust stoichiometrically when contacted with a hot wire or ignitor to produce a metal or metal oxide, nitrogen and water vapor. Again, the use of cerium or scandium oxidizer or monopropellant compounds with or without organic fuels such as azodicarbonamidine dinitrate and/or diammonium 5,5'bitetrazole are not disclosed.

U.S. Pat. No. 5,735,118 discloses a cerium containing compound as a co-oxidizer with other metal complex compounds such as hexamminecobalt nitrate. However, the use of compositions of cerium compounds as singular primary oxidizers with fuels consisting of azodicarbon-amidine dinitrate and/or diammonium 5,5'bitetrazole are not disclosed.

U.S. Pat. No. 5,780,768 to Knowlton et al. discloses a gas generating composition described to be low solids-generating formed from a mixture of a fuel and an oxidizer within a 4% stoichiometric balance. The fuel is selected from the group consisting of guanidine nitrate, nitroguanidine, cellulose, cellulose acetate, hexamene and mixtures thereof. The oxidizer is selected from the group consisting of ceric ammonium nitrate, lithium nitrate, lithium perchlorate, sodium perchlorate, phase stabilized ammonium nitrate, a combination of ammonium nitrate with potassium nitrate, potassium perchlorate and mixtures thereof, such that the combination is a solid solution; a mixture of ammonium perchlorate and at least one alkali metal salt and mixtures thereof; where the fuel is not nitroguanidine when the oxidizer includes ammonium nitrate. This composition may further comprise submicron formed silica to reduce moisture contamination and serve as a processing and powder flow aid and/or binder and may also include an energizing agent. The level of solids produced by the disclosed composition are stated to be less than about 30% and in certain embodiments may be less than about 18%. The most preferred propellant composition, a mixture of guanidine nitrate, ammonium perchlorate and sodium nitrate, fulfills the major objective of this patent, which is to eliminate the air bag inflator filter. The combination of ceric ammonium nitrate is disclosed in combination with guanidine nitrate inflators. Unfortunately, the use of guandine nitrate with ceric ammonium nitrate results in a prohibitively low burning rate. Also, the use of cerium or scandium nitrates or complex nitrates with organic fuels consisting of azodicarbonamidine dinitrate and/or diammonium 5,5'-bitetrazole is not disclosed.

U.S. Pat. No. 5,160,386 to Lund et al. discloses a gas generating composition formed of fuel and a novel oxidizer comprising an inorganic compound with a poly (-nitrito) transition metal complex anion. However, the use of complex nitrates and metal nitrates of cerium or scandium is not discussed with or without the use of azodicarbonamidine dinitrate and/or diammonium 5,5'bitetrazole fuels. Potassium hexanitrocobaltate is the preferred oxidizer. The level of solids produced by the combustion of this composition is not disclosed, however.

In U.S. Pat. No. 5,516,377, Highsmith et al. disclose a gas generating composition based on 5-nitraminotetrazole with an oxidizer that may be an inorganic nitrate or nitrite, a metal oxide, a metal peroxide, an organic peroxide, an inorganic perchlorate, an inorganic chlorate, a metal hydroxide or a mixture of these components. Such low oxygen balance tetrazole systems, however, because of the high concentration of inorganic oxidizers required, tend to produce a high concentration of soluble decomposition products, do not always exhibit optimum ballistic properties and tend to produce higher gas temperatures than desired for vehicle air bags. Again, the use of cerium or scandium based oxidizers with the high oxygen balance fuel, azodicarbonamidine dinitrate, is not disclosed.

A need exists, therefore, for a gas generating propellant composition that can function as either a single component monopropellant or a constituent of a multiple component propellant formulation that combusts to produce an optimum quantity of nontoxic, innocuous, gaseous combustion products and water insoluble solid decomposition products. A need exists, in particular, for propellant formulations which, when combusted, form a minimal to zero concentration of soluble particulate decomposition products to prevent the potential for respiratory system, especially pulmonary, irritation and are effective gas generants.

SUMMARY OF THE INVENTION

It is a primary advantage of the present invention, therefore, to overcome the disadvantages of the prior art and to provide a gas generating propellant composition with an acceptable burning rate useful for vehicle air bags and the like that can function as either a single component monopropellant or a constituent of a multiple component propellant formulation that produces an optimum quantity of nontoxic, innocuous, gaseous combustion products and water insoluble solid decomposition products.

It is another object of the present invention to provide pyrotechnic propellant formulations that are effective propellants and when combusted prevent the potential for asthmatic and other pulmonary conditions.

It is another object of the present invention to provide a water insoluble solids-producing single constituent monopropellant composition that eliminates the processing considerations of a pyrotechnic mixture.

It is a further object of the present invention to provide a gas generating composition useful in a propellant formulation to achieve optimum innocuous gas output, optimum ballistic, mechanical and thermal properties, reduced explosive sensitivity and optimum water insoluble solids forming properties in automotive air bag and similar safety system applications.

It is still another object of the present invention to provide a water insoluble solids-producing gas generating propellant composition useful in pyrotechnic and hybrid inflator systems for vehicle air bags and the like.

It is still a further object of the present invention to provide a monopropellant or gas generant composition that produces a lower concentration of water insoluble solid decomposition products than currently available propellant formulations for vehicle air bags.

It is yet another object of the present invention to provide a high burning rate self-deflagrating water insoluble solids-producing monopropellant or oxidizer fuel mixture useful as a gas generant, propellant, igniter or autoignition device.

Other objects and advantages will be apparent from the following Detailed Descriptions and Claims.

In accordance with the aforesaid objects, the present invention provides salts and complexes of lanthanide and rare earth elements to form monopropellants and constituents of propellant compositions that produce an optimum amount of nontoxic, innocuous gas and a minimal amount of water insoluble solid combustion products at an acceptable burning rate that are suitable for use with pyrotechnic and hybrid inflator systems for vehicle air bags and other safety systems. Lanthanide or rare earth element nitrate salts based on a lanthanide or rare earth cation and a nitrate anion and lanthanide or rare earth complexes containing a nitrate anion are preferred. Preferred metal complexes and salts are based on cerium and scandium.

DETAILED DESCRIPTION OF THE INVENTION

The present invention provides unique components that may be used effectively as monopropellants and/or constituents in propellants, ignition materials and autoignition materials in both all-pyrotechnic and hybrid inflator systems used primarily for vehicle air bags and other safety systems. The all-pyrotechnic systems typically include an inflator with an electrically initiated igniter, a gas generate composition, usually in tablet or pellet form, and a gas filtering system through which the combustion products produced by the gas generant are directed into the air bag, inflating it rapidly in the event a collision sensor is activated. In hybrid inflator systems a stored inert or oxygenated gas, usually argon or helium, is heated to a desired temperature by burning a small amount of propellant. This type of system produces lower temperature gases than the all-pyrotechnic system. Additionally, because water vapor has a high heat capacity, the gas generating composition used should be selected to produce less water vapor than in a pyrotechnic system to keep the gas in the hybrid system at the lower temperature desired. The customization and tailorability of the components of the present invention provide the flexibility needed to enable the optimal use of those components in both types of systems.

Conventional propellant and gas-generating compositions, when burned, form solid very fine particulate decomposition products that are water soluble and extremely difficult to filter out of the gas stream when these compositions are burned to inflate a vehicle air bag or similar safety system. When oxidizers with fuels are combusted inside the inflator, smoke, composed of soluble solid particulates produced by the combustion process, is produced when an air bag inflates. This smoke can be very irritating to the respiratory systems of those who come into contact with it, and can aggravate existing pulmonary conditions, especially pre-asthmatic and asthmatic conditions. The compositions of the present invention have been developed to produce a minimal concentration of only water insoluble and clinkerable solid decomposition products, thus avoiding smoke production and the resulting respiratory system irritation.

The gas-generating compositions of the present invention are salts and complexes of lanthanide and rare earth elements. While it is anticipated that any of the lanthanide and rare earth elements will function effectively in the propellant systems of the present invention, cerium (Ce) and scandium (Sc) are particularly preferred.

Cerium and scandium complex nitrates form one type of composition for use as either monopropellant or oxidizer in multicomponent pyrotechnic mixtures in accordance with the present invention. Preferred high nitrogen containing cations are ammonium, amine, hydrazine, hydroxylamine, guanidine, aminoguanidine, diaminoguanidine, triaminoguanidine, aminotetrazole and the like. Exemplary compositions include:

ammonium hexanitratocerate $[(NH_4)_2Ce(NO_3)_6]$, aminoguanidine hexanitratocerate $[(CH_7N_4)_2Ce(NO_3)_6]$, hydrazine hexanitratocerate $[(N_2H_5)_2Ce(NO_3)_6]$, Nitrate salts based on either a cerium or scandium cation and a nitrate anion form the oxidizer component for another type of pyrotechnic composition in accordance with the present invention. Scandium nitrate $(Sc(No_3)_3)$ is an example of this type of composition. Other lanthanide and rare earth nitrates are also contemplated to fall within this class of compounds.

A particularly preferred example of the composition of the present invention is the reaction product formed by mixing an aqueous slurry and/or solution of aminoguanidine nitrate with an aqueous solution and/or slurry of ammonium hexanitratocerate. The reaction product self-deflagrates very rapidly as a monopropellant when ignited. Consequently, it may be used alone or in a mixture of other components as a gas generant, propellant, igniter, autoignition device, ballistic modifier, densifier, slag former ignition aid and the like.

Examples 1 and 2 below illustrate the combustion of monopropellant compounds according to the present invention.

EXAMPLE 1

The combustion of aminoguanidine hexanitratocerate produces 2.8 moles and 74.02% gaseous combustion products as follows:

$$(CH_7N_4)_2Ce(NO_3)_6 \longrightarrow CeO_2 + 7H_2O + 2CO_3 + 7N_2 + 2\tfrac{1}{2}O_2$$

100% 25.98% 19.04% 13.29% 29.61% 12.08%

The gaseous combustion products are a mixture of water vapor, carbon dioxide, nitrogen and oxygen. The remaining combustion product is solid ceric oxide, which has a high melting point and is a readily filterable water insoluble slagclinker-like material. When combusted by itself as a monopropellant, aminoguanidine hexanitrato-cerate forms at least a 7% lower concentration of solid decomposition products than a number of recently published nonazide mixtures based on 5-aminotetrazole and strontium nitrate.

EXAMPLE 2

When triaminoguanidine hexanitratocerate is combusted by itself as a self-deflagrating monopropellant, 3.0 moles and 76.18% gaseous combustion products are produced as follows:

$$(CH_9N_6)_2Ce(NO_3)_6 \longrightarrow CeO_2 + 9H_2O + 2CO_2 + 9N_2 + 1\tfrac{1}{2}O_2$$

100% 23.82% 22.44% 12.19% 34.90% 6.65%

The mixture of gaseous water vapor, carbon dioxide, nitrogen and oxygen combustion products is in addition to about 24% solid water insoluble ceric oxide.

Scandium nitrate, also particularly useful in the present invention, contains a significantly greater percentage of oxygen per mole than the alkali and alkaline earth nitrates commonly used as air bag gas generators. Scandium nitrate contains 81% oxygen, while potassium nitrate and strontium nitrate contain, respectively, 61% and 58% oxygen. The use of scandium nitrate permits propellant formulations that result in a much lower concentration of solid decomposition product following combustion. In addition, the use of scandium nitrate in propellants produces a scandium oxide water insoluble clinkerslag type of solid combustion product. The use of the cerium nitrate complexes described above in monopropellants or propellant formulations also produces cerium oxide, an insoluble clinkerslag type of solid combustion product. The formation of a water insoluble cerium oxide clinkerslag type of solid combustion product, rather than a soluble solid combustion product is highly desirable because this prevents fine particulate soluble ash from reaching occupants of a vehicle and irritating the vehicle occupants' respiratory systems when an air bag is inflated.

Table I below sets forth examples of reactions of scandium and cerium based oxidizers in accordance with the present invention with azodicarbonamidine dinitrate (azodiformamidine dinitrate) as the fuel. Azodicarbonamidine dinitrate is a novel self-deflagrating propellant fuel with the following structure (1):

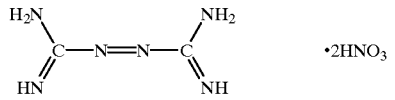

(1)

This composition is described in pending U.S. patent application Ser. No. 08993,882, filed Dec. 18, 1997, entitled Pyrotechnic Gas Generant Composition Including High Oxygen Balance Fuel, and owned by the assignee of the present invention. The disclosure of this application is hereby incorporated herein by reference.

TABLE I

REACTIONS WITH AZODICARBONAMIDINE DINITRATE (1) With Scandium Nitrate:

$$5C_2H_8N_8O_6 + 1\tfrac{1}{3}Sc(NO_3)_3 \rightarrow \tfrac{2}{3}Sc_2O_3 + 2OH_2O + 10CO_2 + 22N_2$$

74.58% 20.42% 6.10% 23.8% 29.18% 40.85%

Total Gas Output = 93.90%

TABLE I-continued

| REACTIONS WITH AZODICARBONAMIDINE DINITRATE | | | | | | | | | | | | |
|---|---|---|---|---|---|---|---|---|---|---|---|---|
| (2) With Ammonium Hexanitratocerate: | | | | | | | | | | | | |
| $8C_2H_8N_8O_6$ | + | $CeH_8N_8O_{18}$ | → | $CeO_2$ | + | $36H_2O$ | + | $12CO_2$ | + | 4CO | + | $36N_2$ |
| 77.80% | | 22.20% | | 6.97% | | 26.26% | | 21.39% | | 4.54% | | 40.84% |
| Total Gas Output = 93.03% | | | | | | | | | | | | |
| (3) With Aminoguanidine Hexanitratocerate: | | | | | | | | | | | | |
| $CeC_2H_{12}N_{14}O_{18}$ | + | $3C_2H_8N_8O_6$ | → | $CeO_2$ | + | $18H_2O$ | + | $8CO_2$ | + | $19N_2$ | | |
| 47.82% | | 52.18% | | 12.46% | | 23.48% | | 25.51% | | 38.55% | | |
| Total Gas Output = 87.54% | | | | | | | | | | | | |

In accordance with the present invention, Table I clearly demonstrates that the reaction of the nitrate salts and metal complex nitrates of scandium and cerium with azodicarbonamidine dinitrate produces a significantly large quantity of substantially innocuous gas and very low amounts of only substantially water insoluble combustion products. The substantially water insoluble combustion products are the oxides of scandium ($Sc_2O_3$) and cerium ($CeO_2$ and $Ce_2O_3$). These oxides are insoluble under aqueous conditions and have less potential for aggravating existing pulmonary conditions, especially pre-asthmatic and asthmatic conditions, of the occupants of a vehicle when an air bag is inflated. Moreover, the toxicity of cerium oxide is very low, especially as compared to sodium oxide and sodium hydroxide, commonly formed as soluble highly irritating corrosive decomposition products of conventional highly toxic sodium azide based air bag propellants. The oral rat LD50 for cerium oxide is 1000 mg/kg as compared to 45 mgkg for sodium azide.

In accordance with the present invention, Table II below sets forth the properties of clinker propellants based on ammonium hexanitratocerate. These propellant formulations produce optimally large amounts of gas and optimally small amounts of substantially water insoluble solid combustion products. Although not shown in Table II, ammonium hexanitratocerate can be effectively combined with both azodicarbonamidine dinitrate and diammonium 5,5'bitetrazole to form an effective clinker propellant that produces a large volume of innocuous gas and a substantially water insoluble solid.

TABLE II

| REACTIONS OF AMMONIUM HEXANITRATOCERATE AND FUEL | | | |
|---|---|---|---|
| Example | 1 | 2 | 3 |
| FORMULATION (weight %) | 22.23 | 38.10 | 65.40 |
| Ammonium hexanitratocerate | | | |
| Azodicarbonamidine dinitrate | 77.77 | — | — |
| Guanidine nitrate | — | 61.90 | — |
| Aminoguanidine nitrate | — | — | — |
| 5-Aminotetrazole | — | — | — |
| Diammonium 5,5'bitetrazole | — | — | 34.60 |
| GAS OUTPUT (weight %) | 93.34 | 88.6 | 80.40 |
| Moles/100 grams | 3.58 | — | — |
| SOLID COMBUSTION PRODUCTS Weight % $CeO_2$ | 6.66 | 11.40 | 19.60 |

Table III below describes various properties of substantially water insoluble solids-producing propellant formulations based on ammonium hexanitratocerate. These formulations all are good slag-forming propellants that produce substantially water insoluble combustion products.

TABLE III

| Example | 1 | 2 | 3 |
|---|---|---|---|
| FORMULATION (weight %)[1] | 22.30 | 38.10 | 65.40 |
| Ammonium hexanitratocerate | | | |
| Azodicarbonamidine dinitrate | 75.70 | — | — |
| Guanidine nitrate | — | 61.90 | — |
| QPAC-40 Polycarbonate binder | 2.00 | — | 2.00 |
| Diammonium 5,5'bitetrazole | — | — | 32.60 |
| HAZARDS DATA (dry blends) | 5 neg/1 kg/45 cm | 10 neg/6 kg/50 cm | 5 neg/1 kg/45 cm |
| Impact, $E_a$ | | | |
| Friction, ABL | 5 neg/100 psi/90° | 10 neg/100 psi/90° | 5 neg/100 psi/90° |
| Electrostatic Discharge ESD | 5 neg at 1.4 J. | 10 neg at 6.0 J. | 5 neg at 1.4 J. |
| BALLISTIC PROPERTIES (0.5 inch pellets) | | | |
| Burning Rate (inches per second) | | | |
| 500 psi | 0.38 | 0.15 | — |
| 1000 psi | 0.56 | 0.19 | 0.37 |
| 2000 psi | 0.99 | 0.26 | 0.65 |
| Pressure Exponent | 0.71 | 0.55 | 0.84 |
| CRUSH STRENGTH, STRESS Initial Crush Strength(psi) | 3595 | 3760 | 10.184 |

[1]0.25 pph graphite added for lubrication during pellet formation

The hazards data shown in Table III are all within acceptable limits and demonstrate that the formulations evaluated are not unduly sensitive. The variation of the burning rate with the novel fuels selected for evaluation indicates that these formulations are adaptable for various inflator designs and result in higher burning rates than exhibited by metal complexes of the prior art. It will also be observed that Example 2 of Table III, the formulation that uses guanidine nitrate as the fuel, exhibited a prohibitively low burning rate. A low burning rate like that exhibited by guanidine nitrate is not desirable because a propellant with a low burning rate must be burned at very high pressures in order to meet the action time envelope for inflation of the air bag. Moreover, higher cost inflator components would be required to accommodate the high pressures needed for the burn rates of these guanidine nitrate formulations. Consequently, the use of azodicarbonamidine dinitrate, diammonium 5,5'bitetrazole or combinations of these fuels in accordance with the present invention produces ideal high burning rates at lower pressures plus water insoluble decomposition products. The crush strength and stress data are acceptable values for propellant compositions.

When the compositions of the present invention are used alone as a single constituent monopropellant, the processing considerations that accompany a pyrotechnic mixture are eliminated. The compositions of the present invention can also be used in a mixture of pyrotechnic ingredients as described above. In this instance, conventional processing aids, such as, for example, binders, pressing aids, oxidizers, fuels, ignition aids, ballistic modifiers, slag formers and the like, may be used to augment gas output, ballistic, mechanical and thermal properties, explosive sensitivity and slag forming properties of the formulation, if desired.

INDUSTRIAL APPLICABILITY

The compositions of the present invention will find their primary applicability as gas generants, monopropellants and pyrotechnic mixtures of oxidizers and fuels for use in vehicle air bags and safety systems. They are also likely to find application in rocket and gun propellants, and in other pyrotechnic and explosives formulations.

What is claimed is:

1. Propellants and gas generator compositions that form a high concentration of substantially innocuous gasses and low concentration of substantially water insoluble, nontoxic solid decomposition products, wherein said compositions are comprised of azodicarbonamidine dinitrate, metal nitrate salts and metal nitrate complexes of lanthanide or rare earth elements.

2. Propellants and gas generating compositions according to claim 1, comprising lanthanide or rare earth element nitrate salts based on a lanthanide or rare earth cation and a nitrate anion.

3. Propellants and gas generating compositions according to claim 2, wherein said lanthanide or rare earth cation comprises cerium or scandium.

4. Propellants and gas generating compositions according to claim 1, wherein said lanthanide or rare earth metal nitrate complexes are selected from the group consisting of ammonium, amine, hydrazine, hydroxyl-amine, guanidine, aminoguanidine, diamino-guanidine, triaminoguanidine and aminotetrazole complexes.

5. Propellant and gas generating compositions according to claim 4, wherein said metal nitrate complexes of lanthanide or rare earth elements include cerium or scandium.

6. A propellant and gas generating composition according to claim 5, wherein said composition comprises ammonium hexanitratocerate, aminoguanidine hexanitratocerate, hydrazine hexanitratocerate, ammonium hexanitratoscandate, aminoguanidine hexanitratoscandate, and hydrazine hexanitratoscandate.

7. A propellant and pyrotechnic gas generating composition according to claim 2, comprising scandium nitrate.

8. Propellants and pyrotechnic gas generator composition according to claim 1, further comprising diammonium 5,5'-bitetrazole.

9. A water insoluble solids-producing gas generating propellant for use in vehicle air bags comprising aminoguanidine hexanitratocerate and azodicarbonamidine dinitrate.

10. A solid pyrotechnic gas generant composition for use in inflators of automotive air bag restraint systems which when combusted generates a high concentration of substantially innocuous gases, and a low concentration of substantially water insoluble nontoxic solid combustion products which limits the potential for asthmatic and pulmonary conditions, including a fuel and an oxidizer therefor, wherein said oxidizer comprises ammonium hexanitratocerate and said fuel comprises azodicarbonamidine dinitrate.

11. A solid pyrotechnic gas generant composition for use in inflators of automotive air bag restraint systems which when combusted generates a high concentration of substantially innocuous gases, and a low concentration of substantially water insoluble nontoxic solid combustion products which limits the potential for asthmatic and pulmonary conditions, including a fuel and an oxidizer therefor, wherein said oxidizer comprises aminoguanidine hexanitratocerate and said fuel comprises azodicarbonamidine dinitrate.

12. A solid pyrotechnic gas generant composition for use in inflators of automotive air bag restraint systems which when combusted generates a high concentration of substantially innocuous gases, and a low concentration of substantially water insoluble nontoxic solid combustion products which limits the potential for asthmatic and pulmonary conditions, including a fuel and an oxidizer therefor, wherein said oxidizer comprises scandium nitrate and said fuel comprises azodicarbonamidine dinitrate.

13. A solid pyrotechnic gas generant composition for use in inflators of automotive air bag restraint systems which when combusted generates a high concentration of substantially innocuous gases, and a low concentration of substantially water insoluble nontoxic solid combustion products which limits the potential for asthmatic and pulmonary conditions, including a fuel and an oxidizer therefor, wherein said oxidizer comprises aminoguanidine hexanitratoscandate and said fuel comprises azodicarbonamidine dinitrate.

14. A solid pyrotechnic gas generant composition for use in inflators of automotive air bag restraint As systems which when combusted generates a high concentration of substantially innocuous gases, and a low concentration of substantially water insoluble nontoxic solid combustion products which limits the potential for asthmatic and pulmonary conditions, including a fuel and an oxidizer therefor, wherein said oxidizer comprises ammonium hexanitratocerate and said fuel comprises azodicarbonamidine dinitrate and diammonium 5,5'bitetrazole.

15. A solid pyrotechnic gas generant composition which is comprised of ammonium hexanitratocerate and azodicarbonamidine dinitrate.

16. The solid pyrotechnic gas generant composition of claim 15, which is further comprised of a polycarbonate binder.

* * * * *